US005431097A

United States Patent [19]

Arnaldi et al.

[11] Patent Number: 5,431,097

[45] Date of Patent: Jul. 11, 1995

[54] CAN CRUSHING DEVICE WITH ROTATABLE CASING

[75] Inventors: Gianluigi Arnaldi; Luigi Gaetani, both of Milan, Italy

[73] Assignee: Promar Limited, Liechtenstein, Liechtenstein

[21] Appl. No.: 252,755

[22] Filed: Jun. 2, 1994

[30] Foreign Application Priority Data

May 13, 1994 [CH] Switzerland ..... 1499/94

[51] Int. Cl.[6] ..... B30B 5/00

[52] U.S. Cl. ..... 100/98 R; 100/239; 100/267; 100/278; 100/902

[58] Field of Search ..... 100/98 R, 238, 239, 100/266, 267, 278, 280, 902

[56] References Cited

U.S. PATENT DOCUMENTS

| | | | |
|---|---|---|---|
| 19,279 | 2/1858 | Disbrow et al. | 100/239 |
| 2,139,143 | 12/1938 | Wiswell | 100/902 |
| 3,104,607 | 9/1963 | Galas | 100/902 |
| 3,934,498 | 1/1976 | Hochanadel | 100/902 |
| 4,248,144 | 2/1981 | Morgan | 100/902 |
| 4,334,469 | 6/1982 | Tanner et al. | 100/902 |

FOREIGN PATENT DOCUMENTS

| | | | |
|---|---|---|---|
| 3733301 | 5/1988 | Germany | 100/902 |
| 58-116997 | 7/1983 | Japan | 100/902 |
| 3-210998 | 9/1991 | Japan | 100/902 |
| 5-200594 | 8/1993 | Japan | 100/902 |

*Primary Examiner*—Stephen F. Gerrity
*Attorney, Agent, or Firm*—Welsh & Katz, Ltd.

[57] ABSTRACT

The device for crushing metal cans has a supporting structure and a crushing head mounted on the supporting structure and forming a region for resting the can to be crushed. The crushing head supports two presser elements arranged mutually opposite along a main axis proximate to the resting region. The device also has a mechanism for moving one of the presser elements towards the other presser element and rotating it about the main axis with respect to the other presser element, whereby to crush a can interposed between the two presser elements.

12 Claims, 4 Drawing Sheets

CAN CRUSHING DEVICE WITH ROTATABLE CASING

BACKGROUND OF THE INVENTION

The present invention relates to a device for crushing metal cans, particularly for crushing cylindrical aluminum-alloy cans for beverages or the like.

An important known environmental problem resides in the disposal of waste consisting, in many cases, of the containers used to package products.

Most of this waste, if adequately collected and segregated according to the material of which it is made, could be recycled almost entirely at low cost, thereby allowing reduced exploitation of natural resources which leads to economic and environmental advantages.

This is certainly the case of cans used to contain beverages or the like. These cans, which are commercially very popular, are in fact generally made of an aluminum alloy, particularly suitable for food-related use, which has a high cost for its extraction from the raw material and can conversely be recycled at low cost.

The main problem that has so far hindered the large-scale recycling of cans for beverages or the like is mainly due to the difficulties arising from the segregated collection of this kind of waste.

Special containers for collecting aluminum waste have long been used for this purpose, but due to the low weight-volume ratio of these products, such containers must have a considerable capacity to make can collection economically convenient. On the other hand there is also the problem of the placement of these containers, which due to their bulk can create environmental impact problems that are difficult to solve.

Containers equipped with a press that crushes the cans beforehand so as to reduce their volume are also known. In this case, the relatively high cost of these devices has limited their widespread use.

SUMMARY OF THE INVENTION

An aim of the present invention is to solve the problems described above by providing a device for crushing cans that has extremely low purchase and running costs, so as to make its large-scale use convenient.

A further object of the invention is to provide a device that can ensure a considerable reduction in can volume despite using a limited actuation force.

Another object of the invention is to provide a device which despite its large collection capacity has a limited overall bulk so as to avoid creating environmental-impact problems.

Another object of the invention is to provide a device which, by virtue of low production costs and of a limited bulk, can enjoy widespread diffusion even in can sales points, so as to make the collection of empty cans easier.

Another object of the invention is to provide a device whose actuation can be considered by the user as a game as to stimulate the user to use it.

With this aim and objects in views there is provided, according to the present invention, a device for crushing metal cans, particularly for crushing cylindrical aluminum-alloy cans for beverages or the like, which comprises a supporting structure and a crushing head mounted on said supporting structure and forming a region for resting the can to be crushed. The crushing head supports two presser elements arranged mutually opposite along a main axis proximate to the resting region, and means are provided for actuating at least one of the presser elements for movement towards the other presser element and for rotation about the main axis with respect to the other presser element to crush a can that is interposed between the two presser elements with its axis substantially coincident with the main axis.

BRIEF DESCRIPTION OF THE DRAWINGS

Further characteristics and advantages of the invention will become apparent from the following description of a preferred but not exclusive embodiment thereof, which is illustrated only by way of non-limitative example in the accompanying drawings, wherein.

DESCRIPTION OF THE PREFERRED EMBODIMENTS

Figure 2:
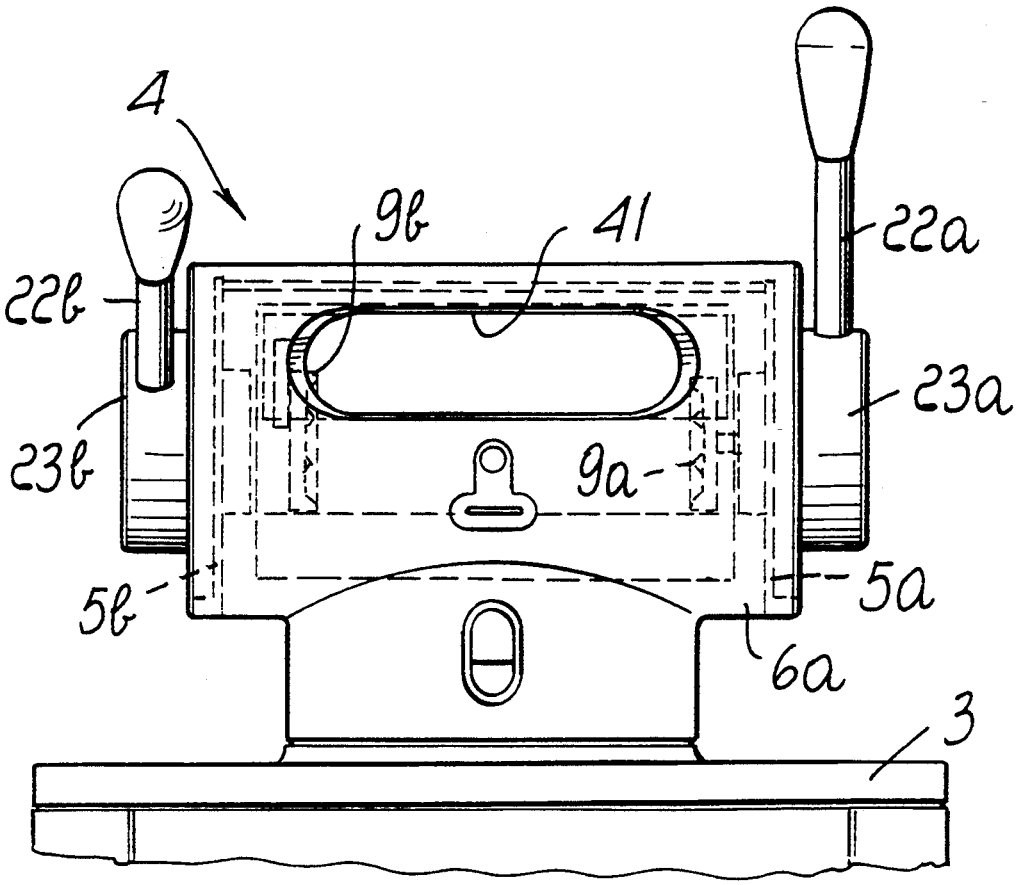
FIG. 2 is a front elevation view of a detail of the device related to the crushing head.

With reference to the above figures, the device according to the invention, generally designated by the reference numeral 1, comprises a supporting structure 2 composed of a base 3 which is internally hollow, which acts as a container for the crushed cans, and which is surmounted by a crushing head 4.

The crushing head 4 is supported by two oppositely arranged lateral shoulders, respectively 5*a* and 5*b*, which are part of the supporting structure since they are rigidly fixed directly to the base 3 or to a housing constituted by two half-shells 6*a* and 6*b* that enclose the crushing head 4 and are in turn fixed to the base 3.

The crushing head 4 forms a region 7 for resting a can 8 to be crushed and supports two presser elements 9*a* and 9*b* arranged mutually opposite along a main axis 10 proximate to the resting region 7. Actuation means act on the presser elements 9*a* and 9*b* and move at least one of the presser elements, the presser element 9*b* in the illustrated case, so that it moves towards the other presser element 9*a* along an actuation direction 11 which is substantially parallel to the main axis 10. The presser element 9*b* with a simultaneous rotation about the main axis 10 with respect to the other element 9*a*, crushes a can 8 that is interposed between the presser elements 9*a* and 9*b*, and is arranged so that its axis substantially coincides with the main axis 10.

More particularly, the crushing head 4 comprises a substantially cylindrical casing 13 which is supported by the lateral shoulders 5*a* and 5*b* so that it can rotate about its own axis, which is horizontal and substantially coincides with the main axis 10. Said casing 13 accommodates the presser elements 9*a* and 9*b* and has, on its lateral surface, an opening 14 which allows one to insert the can 8 to be crushed inside the crushing head.

The presser element 9a is fixed to the lateral shoulder 5a by means of a pivot 15a which passes through one of the bases of the casing 13, designated by the reference numeral 16a, and is locked by an axial screw 17a. The pivot 15a passes through a hole formed coaxially in the base 16a of the casing 13, and a bearing 18a is interposed between the pivot 15a and the base 16a of the casing 13 so that the casing 13 can rotate about the main axis 10 with respect to the lateral shoulder 5a and to the presser element 9a, which remain fixed.

The presser element 9b is accommodated inside the casing 13 and rotates rigidly therewith about the main axis 10, although it can slide with respect to the casing 13 along the actuation direction 11.

More particularly, the presser element 9b has at least one pin 19 extending from the presser element 9b in a radial direction with respect to the main axis 10 and coupling within an axial groove 20 formed on the inner side of the skirt of the casing 13.

Conveniently, there are three pins 19 connected to the presser element 9b, mutually spaced, in an angular and uniform manner, about the main axis 10, and coupling within corresponding grooves 20 formed on the inner side of the casing 13 so as to uniformly distribute the stresses transmitted from the presser element 9b to the casing 13 and vice versa. The coupling between the pins 19 and the grooves 20, which is preferably performed by interposing bearings 21 that facilitate the sliding of the pins 19 along the grooves 20, allows the presser element 9b to rotate rigidly with the casing 13 about the axis 10 and allows the presser element 9b to move inside the casing 13 along the actuation direction 11, as already described.

The actuation means of the device comprise first actuation means for rotating the casing 13, and consequently the presser element 9b, about the main axis 10, and second actuation means, which move the presser element 9b along the actuation direction 11.

Advantageously, the second actuation means are operatively connected to the first actuation means so that the movement of the presser element 9b along the actuation direction 11 occurs simultaneously with the rotation of the presser element 9b about the main axis 10.

More particularly, the first actuation means comprise a lever 22a fixed to a substantially cylindrical lid 23a which is arranged so that its axis coincides with the axis 10 and externally faces the lateral shoulder 5a. The lever 22a protrudes radially from the lid 23a which is fixed, by means of connecting pins 24a that pass through circular arc-like slots 45a formed in the lateral shoulder 5a, to an epicyclic multiplying gearing, generally designated by the reference numeral 25a, that connects the lid 23a to the casing 13.

More particularly, the connecting pins 24a are fixed to the spider 26a of the epicyclic multiplying gearing 25a, and said spider is supported, so that it can rotate about its axis, which coincides with the main axis 10, by a bearing 27a interposed between said spider and the pivot 15a. The spider 26a supports planet gears 28a that mesh with a ring gear 29a fixed within an appropriate cylindrical seat formed on the side of the lateral shoulder 5a which is directed towards the casing 13. The planet gears 28a mesh not only with the fixed ring gear 29a but also with a sun gear 30a which is keyed on a central region of the base 16a of the casing 13. In this manner, a partial rotation of the lid 23a, produced by operating the actuation lever 22a about the main axis 10, causes a rotation of the casing 13 along a wider arc due to the transmission performed by the epicyclic multiplying gearing 25a.

Conveniently, on the outer side of the lateral shoulder 5b there is another lid 23b provided with an actuation lever 22b and connected, similarly to what has been described for the lid 23a, to the spider 26b of an epicyclic multiplying gearing 25b which is in turn connected, again similarly to what has already been described, to the other base 16b of the casing 13. Due to this reason, the elements connecting the lid 23b to the base 16b of the casing 13, which correspond to the elements already described with reference to the lid 23a, have been designated by the same reference numerals and by the suffix "b" in replacement of the suffix "a".

The second actuation means are constituted, for each pin 19, by a cable 32, one end whereof is fixed to a winding spool 33a formed on the side of the lateral shoulder 5a which is directed towards the casing 13. The other end of the cable 32 is fixed to another winding spool 33b formed on the inner side of the lateral shoulder 5b. The axes of the winding spools 33a and 33b conveniently coincide with the main axis 10. The cable 32 is guided inside the casing 13 by sheaves or pulleys, respectively 34a and 34b, which are supported by the bases 16a and 16b of the casing 13. The cable 32 is fixed to the winding spools 33a and 33b so that, by rotating the casing 13 about the main axis 10, the cable winds onto a winding spool 33a or 33b and unwinds from the other winding spool. The cable 32, inside the casing 13, is arranged substantially parallel to the actuation direction 11, and one of its portions is fixed, by means of an appropriate clamp 36, to the related pin 19 so that a rotation of the casing 13 about the main axis 10 causes the cable 32 to slide parallel to the direction 11 in one direction or the other and thus moves the presser element 9b parallel to the actuation direction 11.

Figure 1:
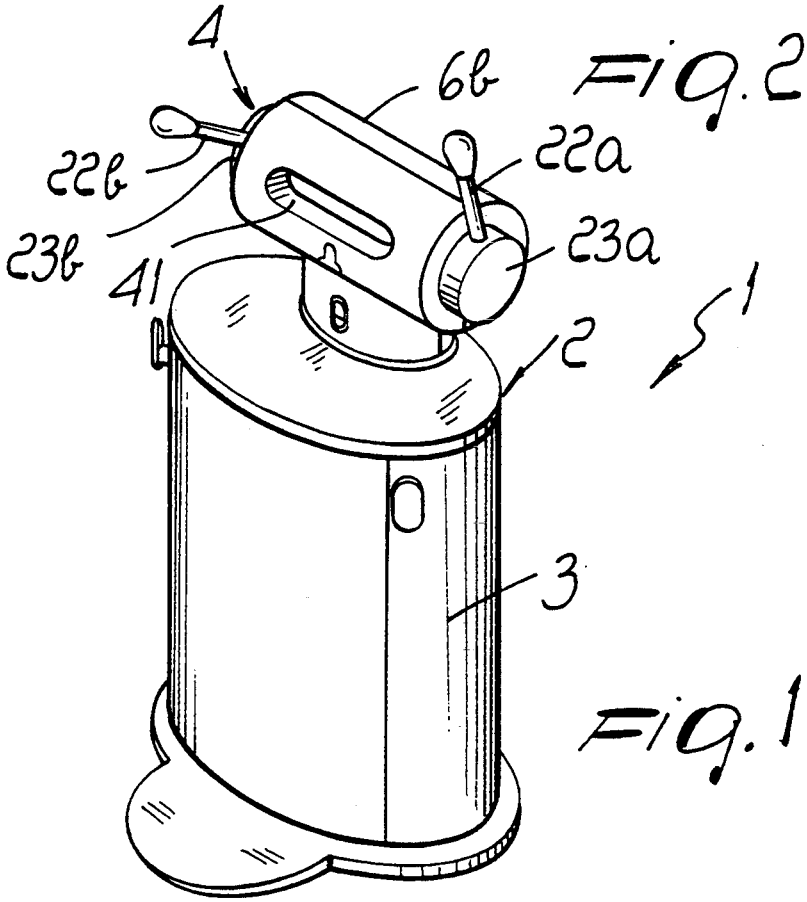
FIG. 1 is a perspective view of the device according to the invention.
Figure 3:
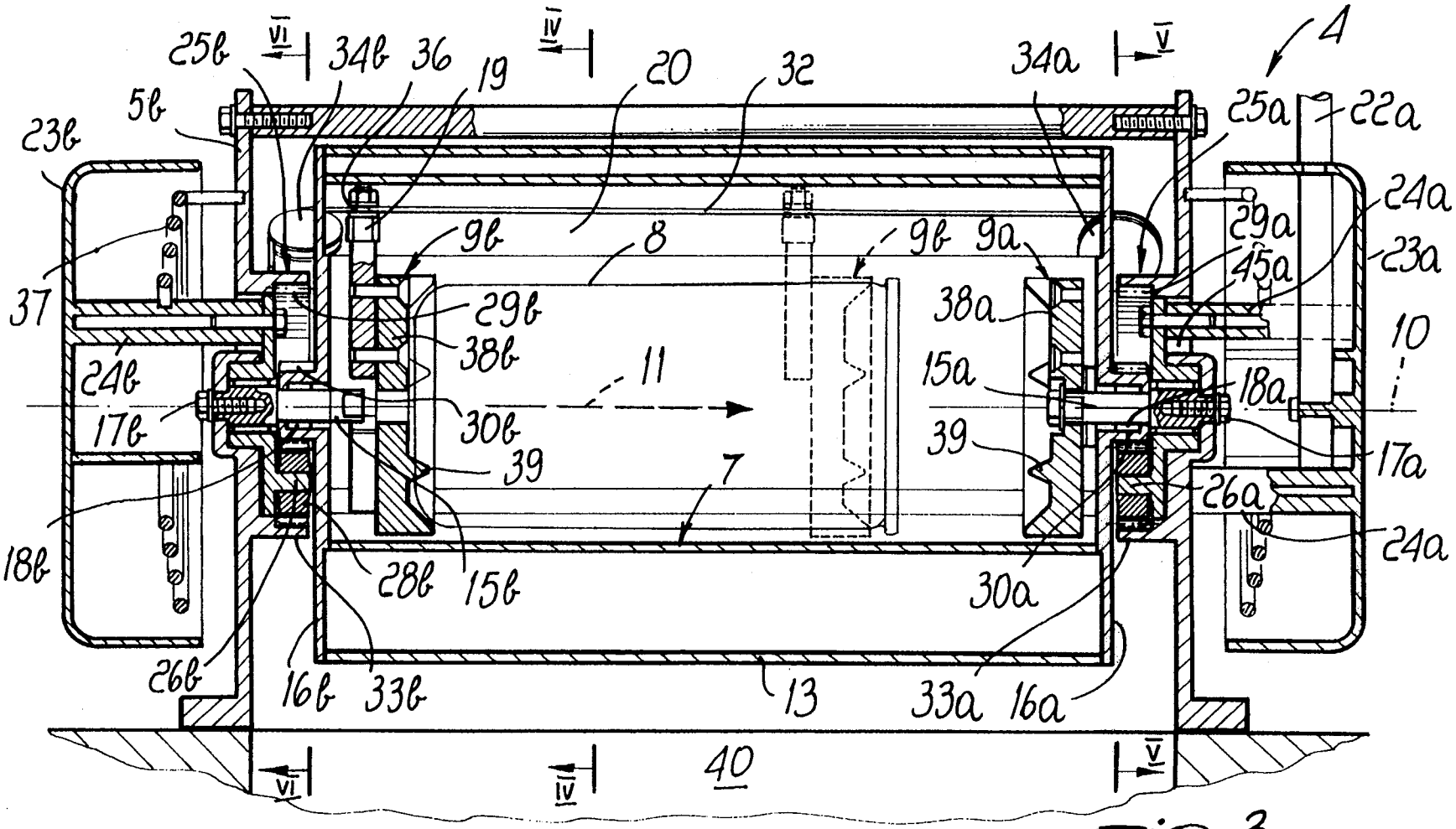
FIG. 3 is an axial sectional view of the crushing head of the device according to the invention.
Figure 5:
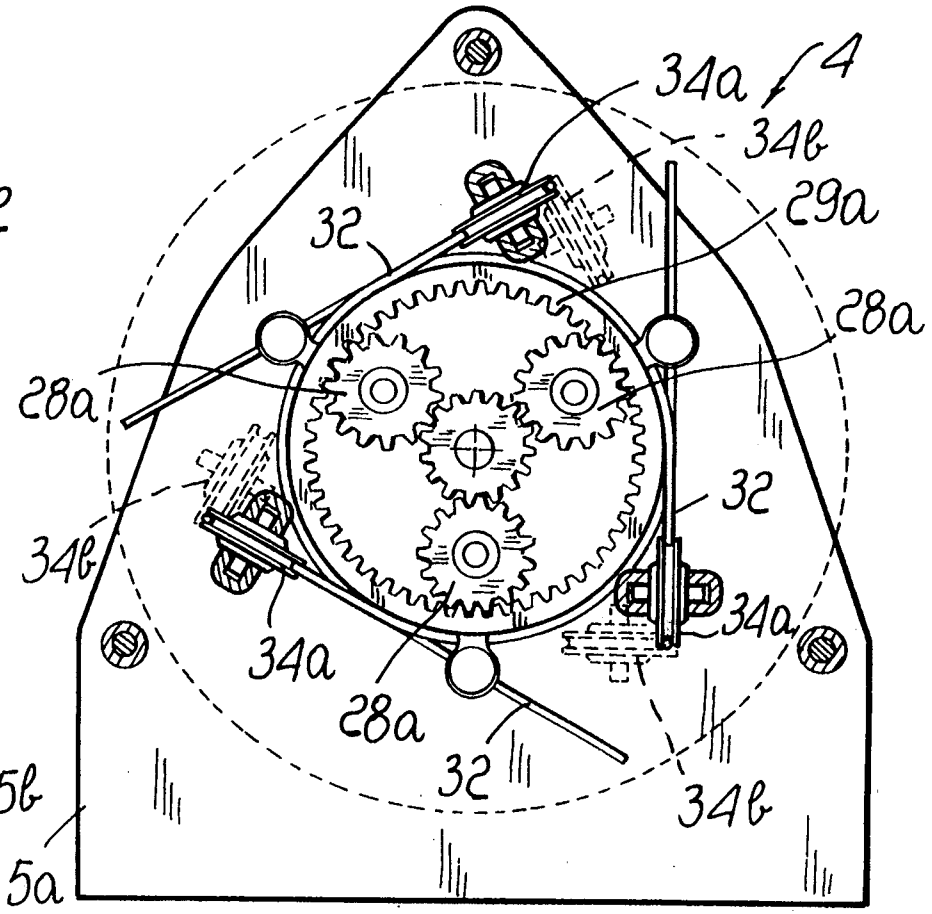
FIG. 5 is a sectional view of FIG. 3, taken along the plane V—V.
Figure 4:
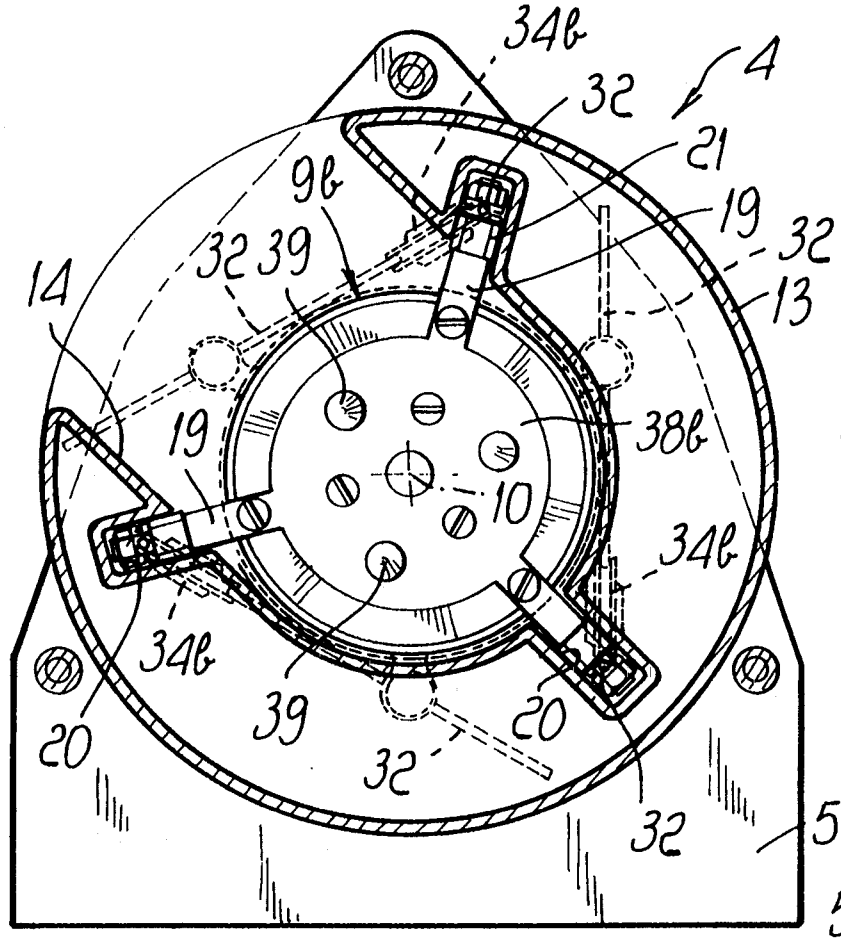
FIG. 4 is a sectional view of FIG. 3, taken along the plane IV—IV.
Figure 7:
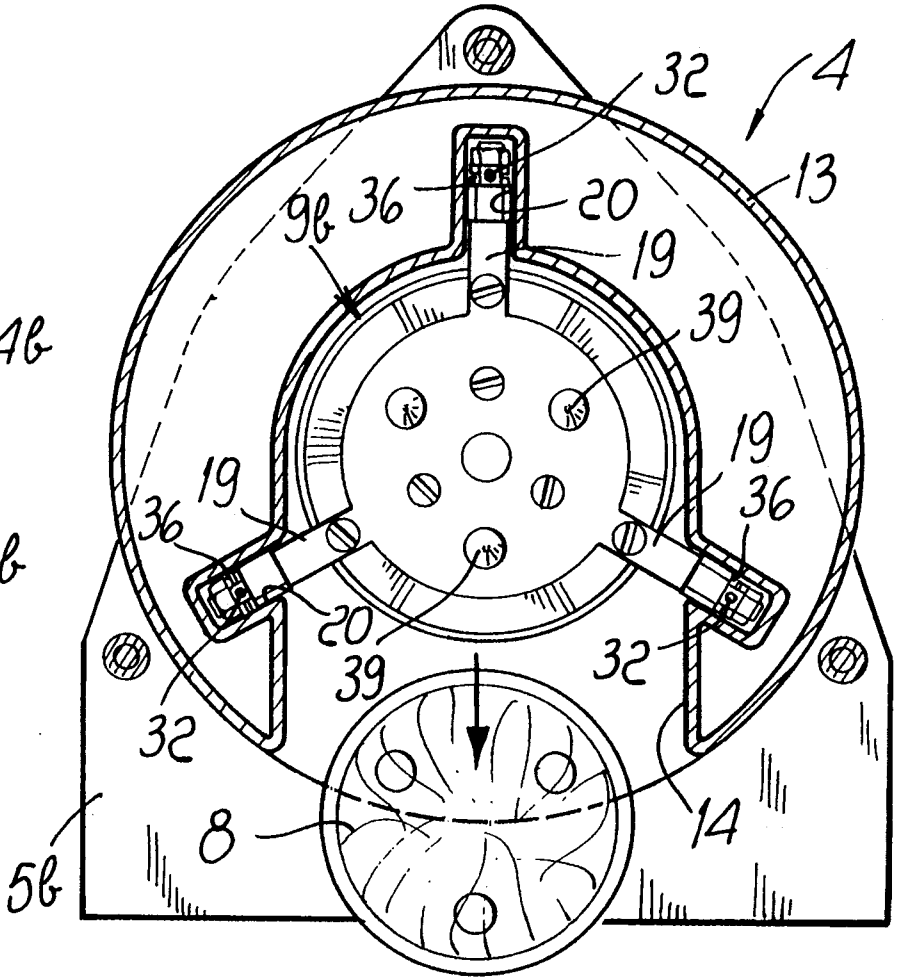
FIG. 7 is a sectional view, taken similarly to FIG. 3, showing the crushing head in another operating condition related to the discharge of a crushed can.
Figure 6:
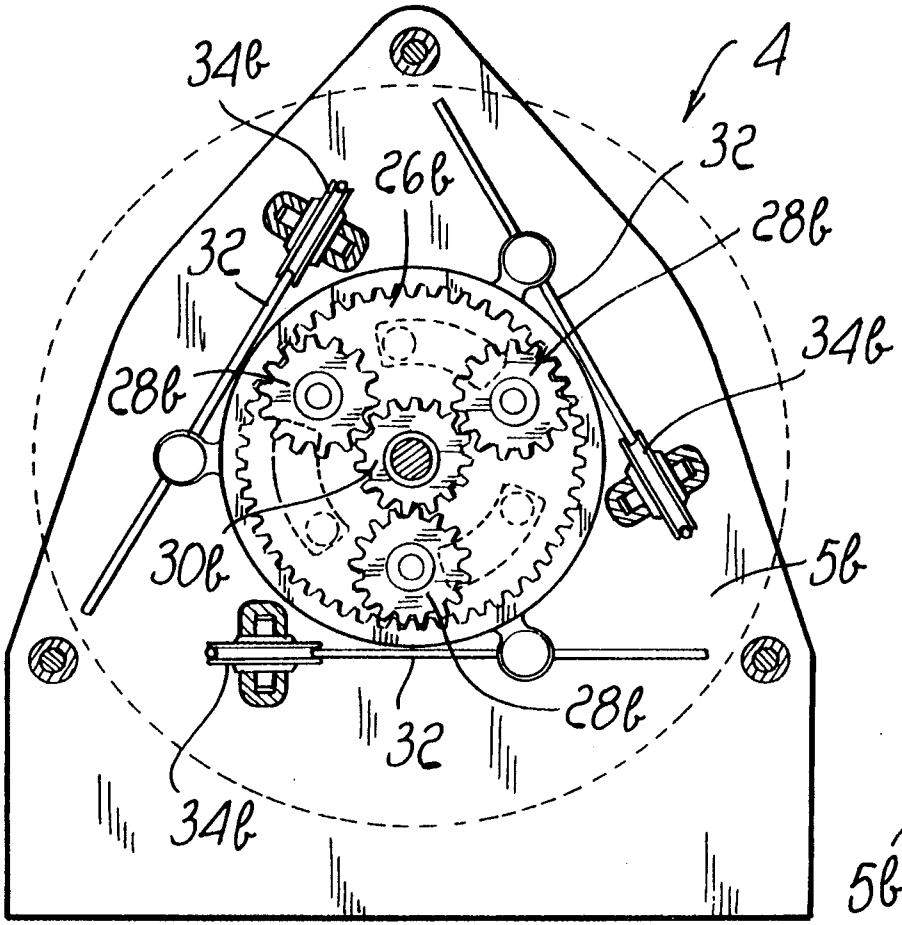
FIG. 6 is a sectional view of FIG. 3, taken along the plane VI—VI.

Conveniently, the two actuation levers 22a and 22b are arranged, as shown particularly in FIGS. 1 and 2, in two mutually different positions so that their actuation is easy for individuals of different heights.

The return rotation of the casing 13 about the main axis 10 can be obtained by virtue of elastic return means constituted for example by a spring 37 which is accommodated inside one of the lids 23a and 23b and which is fixed with one of its ends to one of the lateral shoulders 5a or 5b and with its other end to the body of the related lid 23a or 23b.

Each presser element has a disk-like body 38a and 38b provided, on the face directed towards the other presser element, with studs 39 for engaging the can 12 interposed between the presser elements so as to perforate the bases of the can when compression begins, so as to prevent a possibly unemptied can from exploding due to the action of the presser elements 9a and 9b.

The casing 13 is supported, at its base 16b, by a pivot 15b with the interposition of a bearing 18b fixed to the lateral shoulder 5b by means of a screw 17b.

In the upper part of the base 3, on which the crushing head 4 is mounted, there is an opening 40 whereat the can 8 is arranged by rotation of the casing 13 about the main axis 10, and thus upon crushing the can 8, the crushed can is allowed to fall into the underlying container.

An opening 41 is formed in the half-shell 6a which is arranged on the front side of the device, and the can is inserted in the casing 13 through said opening.

For the sake of completeness in description, it should be noted that on the outer side of the base 3 it is possible to provide hooks to hang optional containers for carrying cans to be crushed to the device.

The operation of the device according to the invention is as follows.

In an inactive condition, the opening 14 of the casing 13 is arranged at the opening 41 of the half-shell 6*a* so that the can 8 to be crushed can be inserted into the casing 13, resting on the region 7 between the presser elements 9*a* and 9*b* so that its axis coincides substantially with the main axis 10. Then one of the actuation levers 22*a* or 22*b* is actuated, causing the rotation of the lids 23*a*, 23*b* about the main axis 10. The rotation of the lids 23*a*, 23*b* is transmitted and multiplied, by the epicyclic multiplying gearing 25*a* and 25*b*, to the casing 13 which by rotating also causes, by means of the cables 32, the translatory motion of the presser element 9*b* towards the presser element 9*a*. In practice, the can 12, interposed between the presser elements 9*a* and 9*b*, is subjected to an axial action due to the movement of the presser element 9*b* towards the presser element 9*a* and is simultaneously subjected to a torsional stress about the main axis 10. The combined action of these two stresses allows to obtain a very high compression of the can with an extremely limited actuation force.

The rotation of the casing 13 about the main axis 10 also moves the opening 14 proximate to the opening 40. When the actuation lever 22*a* or 22*b* is actuated in the opposite direction to return the device to the initial condition, or when said lever is released if the return spring 37 is provided, the presser element 9*b* starts to move away from the presser element 9*a*. During this step, the opening 14 of the casing 13 is arranged exactly at the opening 40, and the can thus crushed is released by the presser elements and drops into the underlying container.

In practice it has been observed that the device according to the invention fully achieves the intended aim, since it allows to effectively perform, with a limited actuation force, the crushing of cans, particularly beverage cans, and to collect in an extremely limited space a large number of cans, thus making it economically convenient to perform the segregated collection of this waste.

The device thus conceived is susceptible to numerous modifications and variations, all of which are within the scope of the inventive concept; thus, for example, the levers 22*a* and 22*b*, which are used to operate the device, can be replaced with automatic actuation mechanisms, such as for example an electric motor. All the details may furthermore be replaced with other technically equivalent elements.

In practice, the materials employed, as well as the contingent shapes and dimensions, may be any according to the requirements and the state of the art.

What is claimed is:

1. A can crushing device comprising a supporting structure and a crushing head mounted on said supporting structure and forming a region for resting a can to be crushed, said crushing head supporting two presser elements arranged mutually opposite along a main axis proximate to said resting region, means being provided for actuating at least one of said presser elements for linear movement towards the other presser element and for rotation about said main axis with respect to said other presser element to crush a can which is interposed between said two presser elements, wherein said crushing head comprises a casing rotatably supported by said supporting structure about said main axis, said casing accommodating said presser elements and having a can insertion opening, said casing being rotatable about said main axis to move said opening between an insertion position, in which said opening is accessable from the outside of the device, and a discharge position, in which said opening faces a container for crushed cans arranged below said crushing head.

2. Device according to claim 1, wherein said one of the presser elements rotates rigidly with said casing in its rotation about said main axis and is slidingly associated with said casing along an actuation direction that is substantially parallel to said main axis.

3. Device according to claim 2, wherein said other presser element is fixed to said supporting structure.

4. Device according to claim 1, wherein said casing is substantially cylindrical and its axis coincides with said main axis and is arranged horizontally.

5. Device according to claim 1, wherein said presser elements have faces upon which can perforation means are provided for engaging the bases of the can.

6. A can crushing device comprising a supporting structure and a crushing head mounted on said supporting structure and forming a region for resting a can to be crushed, said crushing head supporting two presser elements arranged mutually opposite along a main axis proximate to said resting region, means being provided for actuating at least one of said presser elements for linear movement towards the other presser element and for rotation about said main axis with respect to said other presser element to crush a can which is interposed between said two presser elements, wherein said actuation means comprise first actuation means for rotating said casing about said main axis and second actuation means for moving said one of the presser elements along an actuation direction, said second actuation means being operatively connected to said first actuation means to move said one of the presser elements along said actuation direction simultaneously with its rotation about said main axis, wherein said second actuation means comprise two winding spools rigidly coupled to said supporting structure and arranged so that the axis of rotation of the spools substantially coincides with said main axis, said winding spools facing, on opposite sides, the bases of said casing, at least one cable being provided, said at least one cable having ends which are fixed respectively to one and the other of said two winding spools, said cable being guided inside said casing and being connected to said one of the presser elements thereby for partially winding said cable on one of said winding spools and for simultaneously partially unwinding said cable from the other one of said winding spools when said casing rotates about said main axis.

7. Device according to claim 6, wherein said cable is connected to at least one pivot which is rigidly coupled to said one of the presser elements and which can slide inside an axial groove formed on an internal skirt of said casing.

8. Device according to claim 7, wherein said casing has bases at ends thereof and wherein said cable is guided inside said casing by means of pulleys fixed to the outer side of the bases of said casing.

9. Device according to claim 6, wherein said first actuation means comprise at least one actuation lever which is rotatably supported, about said main axis, by said supporting structure and is connected to said casing by transmission means.

10. A can crushing device comprising a supporting structure and a crushing head mounted on said supporting structure and forming a region for resting a can to be crushed, said crushing head supporting two presser elements arranged mutually opposite along a main axis proximate to said resting region, means being provided for actuating at least one of said presser elements for linear movement towards the other presser element and for rotation about said main axis with respect to said other presser element to crush a can which is interposed between said two presser elements, the device further comprising transmission means constituted by an epicyclic multiplying gearing connected to said at least one of said presser elements for providing the linear movement and rotation of said at least one of said presser elements.

11. A can crushing device comprising a supporting structure and a crushing head mounted on said supporting structure and forming a region for resting a can to be crushed, said crushing head supporting two presser elements arranged mutually opposite along a main axis proximate to said resting region, means being provided for actuating at least one of said presser elements for linear movement towards the other presser element and for rotation about said main axis with respect to said other presser element to crush a can which is interposed between said two presser elements, wherein said actuation means comprise first actuation means for rotating said casing about said main axis and second actuation means for moving said one of the presser elements along an actuation direction, said second actuation means being operatively connected to said first actuation means to move said one of the presser elements along said actuation direction simultaneously with its rotation about said main axis, wherein said first actuation means comprise two actuation levers rotatably supported, about said main axis, by said supporting structure and connected to said casing, said casing having a first base and a second base at respective ends thereof, said two actuation levers being connected to respective said bases of said casing.

12. A can crushing device comprising a supporting structure and a crushing head mounted on said supporting structure and forming a region for resting a can to be crushed, said crushing head supporting two presser elements arranged mutually opposite along a main axis proximate to said resting region, means being provided for actuating at least one of said presser elements for linear movement towards the other presser element and for rotation about said main axis with respect to said other presser element to crush a can which is interposed between said two presser elements, wherein said actuation means comprise first actuation means for rotating said casing about said main axis and second actuation means for moving said one of the presser elements along an actuation direction, said second actuation means being operatively connected to said first actuation means to move said one of the presser elements along said actuation direction simultaneously with its rotation about said main axis, the device further comprising elastic return means which act on said casing in the opposite direction with respect to the actuation direction of said first actuation means.

* * * * *